US005213923A

United States Patent [19]

Yokoyama et al.

[11] Patent Number: 5,213,923

[45] Date of Patent: May 25, 1993

[54] PHOTOSENSITIVE MATERIAL FOR ELECTROPHOTOGRAPHY COMPRISING A CHARGE TRANSPORT LAYER COMPRISING AN ORGANOPOLYSILANE AND DIPHENOQUINONE

[75] Inventors: Masaaki Yokoyama, Toyonaka; Eiichi Miyamoto, Osaka; Yasuhiro Yamaguchi, Minoo, all of Japan

[73] Assignee: Mita Industrial Co., Ltd., Osaka, Japan

[21] Appl. No.: 605,272

[22] Filed: Oct. 30, 1990

[30] Foreign Application Priority Data

| | | | |
|---|---|---|---|
| Oct. 31, 1989 | [JP] | Japan | 1-281883 |
| Oct. 31, 1989 | [JP] | Japan | 1-281884 |
| Oct. 31, 1989 | [JP] | Japan | 1-281885 |
| Oct. 31, 1989 | [JP] | Japan | 1-281886 |
| Oct. 31, 1989 | [JP] | Japan | 1-281887 |

[51] Int. Cl.[5] ..... G03G 5/10

[52] U.S. Cl. ..... 430/58; 430/96; 430/70

[58] Field of Search ..... 430/58, 96, 70

[56] References Cited

U.S. PATENT DOCUMENTS

| | | | |
|---|---|---|---|
| 4,609,602 | 9/1986 | Ong et al. | 430/58 |
| 4,871,646 | 10/1989 | Hayase et al. | 430/192 |
| 4,943,501 | 7/1990 | Kinoshita et al. | 430/58 |

*Primary Examiner*—Marion E. McCamish
*Assistant Examiner*—S. Rosasco
*Attorney, Agent, or Firm*—Sherman and Shalloway

[57] ABSTRACT

Disclosed is a photosensitive material for the electrophotography, comprising as the charge-transporting substance a composition comprising an organic polysilane and a member selected from the group consisting of an electron-accepting substance, a diphenoquinone derivative, a low-molecular-weight hole-transporting substance, a high-molecular-weight polycyclic hindered phenol and an n-type charge-generating substance. Even if this photosensitive material is subjected to charging and light exposure repeatedly or irradiated with ultraviolet rays, quantities of charges of the surface voltage and residual voltage are very small, and the photosensitive material has an excellent resistance to the repetition of charging and light exposure operations and an excellent light resistance.

8 Claims, 1 Drawing Sheet

PHOTOSENSITIVE MATERIAL FOR ELECTROPHOTOGRAPHY COMPRISING A CHARGE TRANSPORT LAYER COMPRISING AN ORGANOPOLYSILANE AND DIPHENOQUINONE

BACKGROUND OF THE INVENTION (1) Field of the Invention

The present invention relates to a photosensitive material for electrophotography, which is used in a copying machine, a laser printer and the like. More particularly, the present invention relates to a photosensitive material for electrophotography, in which rise of the surface voltage or residual voltage caused on repetition of charging and light exposure is controlled and good electrophotography characteristics are stably obtained over a long period.

(2) Description of the Related Art

In the field of photosensitive materials for electrophotography, so-called function-separated type organic photosensitive materials having laminate structure comprising a charge-generating layer (CGL) and a charge-transporting layer (CTL) have been gradually used. Single-layer dispersion type organic sensitive materials comprising a charge-generating substance dispersed in a medium of a charge-transporting substance have already been known as well as the above laminate type photosensitive materials.

A substance having a high carrier mobility is required as the charge-transporting substance for these photosensitive materials, and polymeric materials initially used, such as polyvinyl carbazole (PVC), have been replaced by low-molecular-weight compound materials used in resin dispersions. However, in view of the molding processability, it is preferred that a film-forming substance which can be used singly be used as the charge-transporting substance. The above-mentioned PVC has a film-forming property, but is defective in that the dimer site formed by adjacent carbazole rings acts as the hole carrier trap to cause reduction of the electrophotography characteristics of the the photosensitive material.

Recently, Japanese Unexamined Patent Publication No. 61-170747 proposes a photosensitive material comprising an organic polysilane as the hole-transporting material. This organic polysilane can be formed into a film from a solution, and it is known that of amorphous polymeric materials, the organic polysilane has a higher hole drift mobility (up to $10^{-4}$ $cm^2/V.sec$).

Not only initial characteristics but also a good stability at the repeated use is required for a photosensitive material to be loaded on a copying machine and the like, but in connection with a photosensitive material comprising the organic polysilane, this stability has not been sufficiently examined.

We made investigations with a view to applying an organic polysilane to a commercial photosensitive material for the electrophotography, and as the result, it was found that if this photosensitive material is subjected to charging-light exposure repeatedly, especially if the photosensitive material is irradiated with light containing ultraviolet rays, for example, light of a fluorescent lamp or xenon lamp, or sunbeams, the surface voltage and residual voltage of the photosensitive material rise, with the result that the density of the copied image is charged or fogging is caused.

SUMMARY OF THE INVENTION

It is therefore a primary object of the present invention to provide a photosensitive material for electrophotography, comprising an organic polysilane as the charge-transporting substance (hole-transporting substance), in which at the repetition of charging and light exposure, especially at the light exposure, deterioration by irradiation with ultraviolet ray and rise of the surface voltage or residual voltage can be controlled, and good electrophotographic characteristics can be stably maintained over a long period. In this photosensitive material, the high hole drift mobility inherently possessed by the organic polysilane is maintained and stable electrophotographic characteristics are manifested together with a high sensitivity.

In accordance with the present invention, there is provided a photosensitive material for the electrophotography, which comprises a charge-generating substance and a charge-transporting substance in the laminate form or single layer separated form, wherein the charge-transporting substance is an organic polysilane composition comprising a member selected from the group consisting of electron-accepting substances, diphenoquinone derivatives, low-molecular-weight hole-transporting substances, high-molecular-weight hole-transporting substances, high-molecular-weight polycyclic hindered phenols and n-type charge-generating substances.

In the charge-transporting substance used for the photosensitive material for the electrophotography according to the present invention, the electron-accepting substance, diphenoquinone derivative, low-molecular-weight hole-transporting substance, high-molecular-weight polycyclic hindered phenol or n-type charge-generating substance is preferably contained in an amount of 0.1 to 30 parts by weight, especially 1 to 15 parts by weight, per 100 parts by weight of the organic polysilane.

The electron-accepting substance is especially preferably a substance having an electronic affinity of at least 2.0.

The high-molecular-weight polycyclic hindered phenol is especially preferably 1,1,3-tris(2-methyl-4-hydroxy-5-tert-butylphenyl)butane.

The n-type charge-generating substance is especially preferably a perylene pigment.

DETAILED DESCRIPTION OF THE INVENTION

Figure 1:
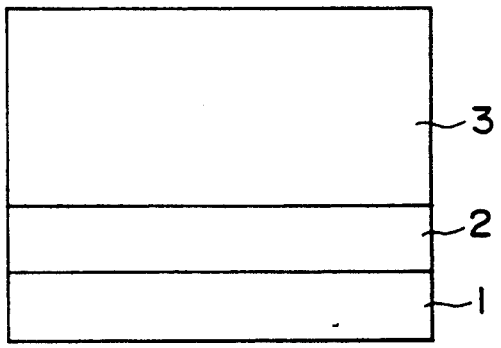
FIG. 1 is a sectional view illustrating a negatively charging type laminate photosensitive material according to the present invention.

The present invention is based on the finding that if an electron-accepting substance, a diphenoquinone derivative, a low-molecular-weight hole-transporting substance, a high-molecular-weight polycyclic hindered phenol or an n-type charge-generating substance is incorporated into an organic polysilane, the stability of the photosensitive material is maintained even if charging-light exposure operations are repeated, and rise of the surface voltage or residual voltage can be prominently controlled. When an electron-accepting substance is incorporated, the light resistance of the photosensitive material under irradiation with ultraviolet rays is especially improved.

As pointed out hereinbefore, when a photosensitive material comprising an organic polysilane as the charge-transporting substance is subjected to charge-light exposure repeatedly, both of the surface voltage and the residual voltage considerably rise. This rise of the surface voltage or the residual voltage is due to deterioration of the surface of the organic polysilane layer, and the carrier-transporting capacity of the surface portion is reduced and the surface voltage and residual voltage are caused to rise. The mechanism of this deterioration has not been completely elucidated, but it is believed that by ultraviolet light or ozone generated at the time of charging or excited singlet oxygen, the main chain bond Si-Si is cut and an insulating film is formed on the surface to elevate the surface voltage and by the repetition of charging-light exposure, charges are accumulated in this insulating film to elevate the residual voltage.

From the results of various experiments made by us, it was found, as a phenomenon, that if any one of the above-mentioned five kinds of substances is incorporated in an organic polysilane, deterioration of the organic polysilane layer is prevented and the stability is improved. The phenomenon has not been completely elucidated, but it is believed that the reason will be as described below with respect to each of these substances.

Electron-Accepting Substance

It is considered that if an electron-accepting substance, described in detail hereinafter, is incorporated in an organic polysilane, and the excited state of the organic polysilane is deactivated by the incorporated electron-accepting substance, deterioration of the surface or formation of radical species is inhibited. This coincides exactly with the experimental fact that the fluorescence of the organic polysilane is effectively quenched by an electron-accepting substance, especially an electron-accepting substance having an electronic affinity of at least 2.0, as shown in Table 1.

TABLE 1

Quenching Constant K of Electron-Accepting Substance to Organic Polysilane

| Electron-Accepting Substance | Electronic Affinity | K ($M^{-1}$) |
|---|---|---|
| BQ | 1.98 | $3.0 \times 10^2$ |
| DCBQ | 2.31 | $3.5 \times 10^3$ |
| DMDB | 2.01 | $1.5 \times 10^4$ |
| TNF | 2.10 | $1.4 \times 10^5$ |
| TPN | 1.10 | not quenched |

BQ: p-benzoquinone
DCBQ: 1,4-dichlorobenzoquinone
DNDB: 2,6-dimethyl-2',6'-di-tert-buthyldiphenoquinone
TNF: 2,4,7-trinitrofluorenone
TPN: terephthalonitrile Incidentally, data of the electronic affinities of electron-accepting substances are quoted from E. C. Chen and W. E. Wentworth, J. Chem. Phys., 62, 3183 (1975).

Diphenoquinone Derivative

It is considered that if a diphenoquinone derivative is incorporated into an organic polysilane, the excited organic polysilane is deactivated by the electron-accepting property of the diphenoquinone derivative, whereby deterioration of the organic polysilane or formation of radical species is inhibited. This can be confirmed from the fact that the fluorescence of the organic polysilane is effectively quenched by the diphenoquinone derivative. Moreover, it is considered that since the diphenoquinone derivative per se is stable, a prominent effect is attained.

The diphenoquinone derivative used in the present invention shows an especially high effect of controlling the rise of the surface voltage and residual voltage at the repetition of the charging-light exposure operations. Furthermore, the diphenoquinone derivative shows a good quenching effect and improves the light resistance of the photosensitive material against ultraviolet rays. It is considered that this effect is due to the specific chemical structure of the diphenoquinone derivative, that is, the conjugated bond structure.

Still further, since the diphenoquinone derivative used in the present invention has an excellent compatibility with the organic polysilane and has a high electron-transporting capacity, the diphenoquinone derivative exerts an advantageous action of preventing accumulation of charges in the organic polysilane.

Low-Molecular-Weight Hole-Transporting Substance

It is considered that if a low-molecular-weight hole-transporting substance, described in detail hereinafter, is incorporated in an organic polysilane, since the excited organic polysilane is deactivated by the low-molecular-weight hole-transporting substance, deterioration of the surface of the photosensitive layer and formation of radical species are inhibited. This consideration coincides well with the fact that the fluorescence of the organic polysilane is quenched by addition of the low-molecular-weight hole-transporting substance. Furthermore, by the addition of the low-molecular-weight hole-transporting substance, the efficiency of injection of holes from the charge-generating layer is improved, and also by this effect, the residual voltage can be reduced.

High-Molecular-Weight Polycyclic Hindered Phenol

If a high-molecular-weight polycyclic hindered phenol is incorporated into an organic polysilane, this specific phenol per se reacts preferentially with a component deteriorating the surface and exerts a function of preventing deterioration of the organic polysilane and controlling the rise of the surface voltage or residual voltage. Moreover, since the added phenol or its reaction product does not act as a trap to the organic polysilane, the initial characteristics are not degraded.

The high-molecular-weight polycyclic hindered phenol used in the present invention is known as an antioxidant. However, in view of the fact that BHT (2,6-di-tert-butyl-4-methylphenol), is a typing antioxidant, has no substantial effect of preventing the rise of the surface voltage and residual voltage at the repetition of the charging-light exposure operations, in order to attain the object of the present invention, it is important that the phenol should be in the form of a high-molecular-weight polycyclic phenol.

n-Type Charge-Generating Substance

If an n-type charge-generating substance is incorporated in an organic polysilane, the stability is improved, and it is considered that this improvement is due to the masking effect of the substance to ultraviolet rays and the like. However, if a p-type charge-generating substance such as a phthalocyanine pigment is incorporated, no substantial stabilizing effect is attained, and therefore it is considered that there should also be exerted an action other than the masking action. From the results of the light resistance test under irradiation with ultraviolet rays, it has been confirmed that the n-type charge-generating substance deactivates the excited state of the organic polysilane and acts as a quencher. Furthermore, the stabilizing effect by pulling out electrons of anion radicals generated and locally distributed in the organic polysilane by the n-type charge-generating substance can be considered.

The components of the photosensitive material of the present invention will now be described in detail.

A known organic polysilane can be optionally used in the present invention. In general, the organic polysilane used in the present invention comprises a main chain consisting of silicon atoms and a side chain consisting of an organic group, especially a monovalent hydrocarbon group, and has recurring units represented by the following formula:

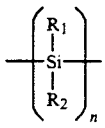

(1)

wherein $R_1$ and $R_2$ independently represent a monovalent hydrocarbon group, especially an alkyl group having up to 4 carbon atoms, an aryl group having at least 6 carbon atoms or an aralkyl group.

As examples of the organic polysilane preferably used in the present invention, there can be mentioned methylphenylpolysilane, methylpropylpolysilane, methyl-t-butylpolysilane, diphenylpolysilane, methyltolylpolysilane and copolymers thereof.

The organic polysilane should have a so-called film-forming molecular weight. It is generally preferred that the weight average molecular weight (Mw) of the organic polysilane be from 5000 to 50000, especially from 5000 to 20000.

The terminal of the organic polysilane may be a silanol group, an alkoxy group or the like.

A known electron-accepting substance can be optionally used, but an electron-accepting substance having an electronic affinity of at least 2.0 is effectively used. As examples of the electron-accepting substance preferably used in the present invention, there can be mentioned tetracyanoethylene, 2,4,7-trinitro-9-fluorenone, 3,4,5,7-tetranitro-9-fluorenone, chloranil, 1,4-naphthoquinone and 2,6-dichlorobenzoquinone, though electron-accepting substances that can be used in the present invention are not limited to the compounds mentioned above.

The electron-accepting substance is used in an amount of 0.1 to 30 parts by weight, especially 1 to 15 parts by weight, per 100 parts by weight of the organic polysilane. If the amount of the electron-accepting substance is too small and below the above-mentioned range, the effect of controlling the rise of the surface voltage or residual voltage under irradiation with ultraviolet rays is lower than the effect attained when the amount is within the above-mentioned range. If the amount of the electron-accepting substance exceeds the above range, the sensitivity is lower than the sensitivity attained when the amount is within the above range.

The electron-accepting substance used in the present invention is soluble in a solvent for the organic polysilane, for example, tetrahydrofuran (THF), the electron-accepting substance can be mixed intimately with the organic polysilane.

A compound represented by the following general formula is preferably used as the diphenoquinone derivative in the present invention:

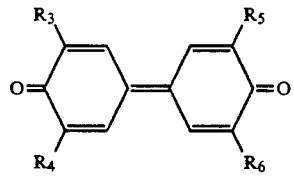

(2)

wherein $R_3$, $R_4$, $R_5$ and $R_6$ independently represent a hydrogen atom, an alkyl group, a cycloalkyl group, an aryl group or an aralkyl group.

As examples of the diphenoquinone derivative preferably used in the present invention, there can be mentioned 2,6-dimethyl-2',6'-di-t-butylphenoquinone, 2,2'-dimethyl-6,6'-di-t-butyldiphenoquinone, 2,6'-dimethyl-2',6'-di-t-butylphenoquinone, 2,6,2',6'-tetramethyldiphenoquinone, 2,6,2',6'-tetra-t-butyldiphenoquinone, 2,6,2',6'-tetraphenyldiphenoquinone and 2,6,2',6'-tetracyclohexyldiphenoquinone, though diphenoquinone derivative that can be used in the present invention are not limited to the compounds mentioned above.

A known low-molecular-weight hole-transporting substance can be optionally used in the present invention. For example, there can be used nitrogencontaining cyclic compounds and fused polycyclic compounds, for instance, oxidiazole compounds such as 2,5-di(4-methylaminophenyl)-1,3,4-oxadiazole, styryl compounds such as 9-(4-diethylaminostyryl)anthrathene, pyrazoline compounds such as 1-phenyl-3-(p-dimethylaminophenyl)pyrazoline, hydrozone compounds, triphenylamine compounds, indole compounds, oxazole compounds, isoxazole compounds, thiazole compounds, thiadiazole compounds, imidazoel compounds, pyazole compounds and triazole compounds. An N,N,N',N'-tetraphenyl-m-phenylenediamine compound represented by the following formula:

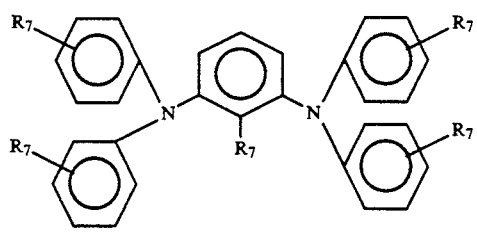

(3)

wherein $R_7$ represents a hydrogen atom, an alkyl group, an alkoxy group or a halogen atom, is preferably used as the low-molecular-weight hole-transporting substance.

The low-molecular-weight hole-transporting substance is used in an amount of 1 to 30 parts by weight, especially 5 to 15 parts by weight, per 100 parts by weight of the organic polysilane. If the low-molecular-weight hole-transporting substance is used in an amount smaller than the above range, the effect of controlling the rise of the surface voltage or residual voltage at the repetition of charging-light exposure operations is lower than the effect attained when the amount is within the above range. If the amount of the low-molecular-weight hole-transporting substance exceeds the above range, the sensitivity is lower than the sensitivity attained within the amount is within the above range.

A tri- to tetra-cyclic phenol having a molecular weight of at least 600 is used as the high-molecular-weight polycyclic hindered phenol in the present invention, and 1,1,3-tris(2-methyl-4-hydroxy-5-tert-butylphenyl)butane is especially preferably used. As another examples of the polycyclic hindered phenol, there can be mentioned tetrakis(methylene-3(3,5-di-tert-butyl-4-hydroxyphenyl)propionate)methane, 2,2'-methylbis(4-methyl-6-tert-butylphenol), 4,4'-butylidenebis(3-methyl-6-tert-butylphenol), triethylene glycolbis(3-(3-tert-butyl-5-methyl-4-hydroxyphenyl)propionate), 1,6-hexanediol-bis(3-(3,5-di-tert-butyl-4-hydroxyphenyl)propionate) and tris-(3,5-di-tert-butyl-4-hydroxybenzyl)-isocyanurate.

The high-molecular-weight polycyclic hindered phenol is used in an amount of 1 to 50 parts by weight, especially 5 to 30 parts by weight, per 100 parts by weight of the organic polysilane. If the amount of the hindered phenol is too small and below the above range, the effect of controlling the rise of the surface voltage o residual voltage at the repetition of the charging-light exposure operations is lower than the effect attained when the amount is within the above range. If the amount of the hindered phenol exceeds the above range, the sensitivity is lower than the sensitivity attained when the amount is within the above range.

The high-molecular-weight polycyclic hindered phenol used in the present invention is soluble in a solvent for the organic polysilane, for example, tetrahydrofuran (THF). Therefore, the hindered phenol can be mixed intimately with the organic polysilane.

A perylene pigment can be preferably used as the n-type charge-generating substance in the present invention. As suitable examples of the perylene pigment, there can be mentioned pigments represented by the following general formula:

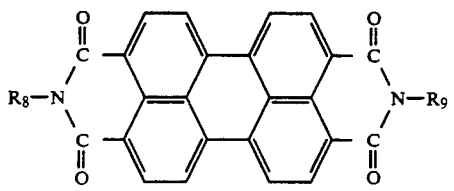

(4)

wherein $R_8$ and $R_9$ independently represent a hydrogen atom or a substituted or unsubstituted alkyl or aryl group.

As the alkyl group, there can be mentioned lower alkyl groups having 1 to 6 carbon atoms.

As the aryl group, there can be mentioned a phenyl group, a naphthyl group and an anthryl group, and phenyl group is preferable. As the substituent for the aryl group, there can be mentioned alkyl groups as mentioned above, a hydroxyl group, alkoxy groups such as methoxy, ethoxy, propoxy and butoxy groups, and halogen atoms such as fluorine, chlorine, bromine and iodine.

As specific examples of the perylene compounds represented by the general formula (4), there can be mentioned N,N'-dimethylperylene-3,4,9,10-tetracarboxydiimide, N,N'-diethylperylene-3,4,9,10-tetracarboxydiimide, N,N'-diethylperylene-3,4,9,10-tetracarboxydiimide, N,N'-dipropylperylene-3,4,9,10-tetracarboxydiimide, N,N'-diisopropylperylene-3,4,9,10-tetracarboxydiimide, N,N'-dibutylperylene-3,6,9,10-tetracarboxydiimide, N,N'-di-tert-butylperylene-3,4,9,10-tetracarboxydiimide, N,N'-di(3,5-dimethylphenyl)perylene-3,4,9,10-tetracarboxydiimide, N,N'-di(3-methyl-5-ethylphenyl)perylene-3,4,9,10-tetracarboxydiimide, N,N'-di(3,5-diethylphenyl)perylene-3,4,9,10-tetracarboxydiimide, N,N'-di(3,5,-di-n-propylphenyl)perylene-3,4,9,10-tetracarboxydiimide, N,N'-di(3,5-diisopropylphenyl)perylene-3,4,9,10-tetracarboxydiimide, N,N'-di(3methyl-5-isopropylphenyl)perylene-3,4,9,10-tetracarboxydiimide, N,N'-di(3,5-di-n-butylphenyl)perylene-3,4,9;10-tetracarboxydiimide, N,N'-di(3,5-di-tert-butylphenyl)perylene-3,4,9,10-tetracarboxydiimide, N,N'-di(3,5-dipentylphenyl)perylene-3,4,9,10-tetracarboxydiimide and N,N'-di(3,5-dihexylphenyl)perylene-3,4,9,10-tetracarboxydiimide. Among them, N,N'-di(3,5-dimethylphenyl)perylene-3,4,9,10-tetracarboxydiimide is especially preferable in view of the easy availability.

Instead of the foregoing perylene pigments, there can be used a bisazo pigment represented by the following formula and dibromoanthanthrone as the n-type charge-generating substance:

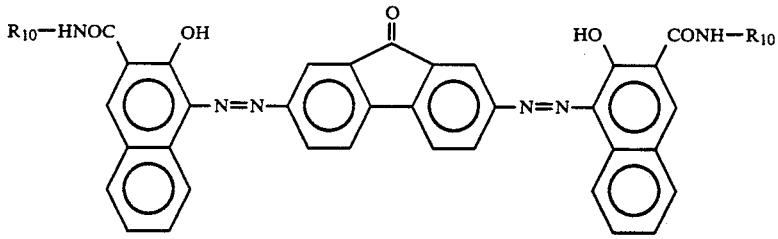

(5)

wherein $R_{10}$ represents an alkyl group, an aryl group or an aralkyl group.

The n-type charge-generating substance is used in an amount of 0.1 to 10 parts by weight, especially 1 to 5 parts by weight, per 100 parts by weight of the organic polysilane. If the amount of the n-type charge-generating substance is too small and below the above range, teh effect of controlling the rise of the surface voltage and the residual voltage at the repetition of charging-light exposure operations is lower than the effect attained when the amount is within the above range. If the amount of the n-type charge-generating substance exceeds the above range, the sensitivity and chargeability are lower than those attained when the amount is within the above range.

The structure of the photosensitive material of the present invention will now be described.

Figure 2:
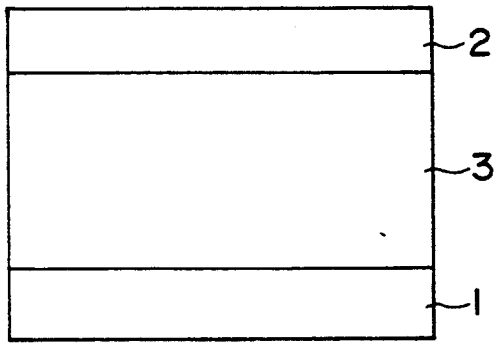
FIG. 2 is a sectional view illustrating a positively charging type laminate photosensitive material according to the present invention.

The present invention can be applied to a laminate type photosensitive material for the electrophotography and a single layer dispersion type photosensitive material for the electrophotography. For example, as shown in FIG. 1, a charge-generating layer (CGL) 2 is formed on an electroconductive substrate 1, and a charge-transporting layer (CTL) 3 composed of the above-mentioned organic polysilane composition is formed on the charge-generating layer. Alternatively, as shown in FIG. 2, a charge-transporting layer 3 composed of the above-mentioned organic polysilane composition is formed on an electroconductive substrate 1, and a charge-generating layer 2 is formed on the charge-transporting layer.

Figure 3:
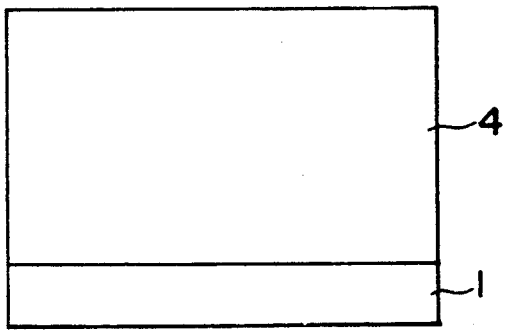
FIG. 3 is a sectional view illustrating a positively charging type single-layer photosensitive material according to the present invention.

In the case where any of the four kinds of additives other than the n-type charge-generating substance is incorporated into the organic polysilane, as shown in FIG. 3, a dispersion comprising a charge-generating substance 2' in a charge-transporting medium 3' composed of the organic polysilane composition is formed as a single photosensitive layer 4 on an electroconductive substrate 1.

As the charge-generating substance, there can be mentioned selenium, selenium-tellurium, amorphous silicon, a pyrylium salt, an azo pigment, a disazo pigment, an anthanthrone pigment, a phthalocyanine pigment, an indigo pigment, a threne pigment, a toluidine pigment, a pyrazoline pigment, a perylene pigment and a quinacridone pigment. Two or more of these pigments can be used in combination so that a desired absorption wavelength region is attained.

The charge-generating substance can be applied in the form of a layer by such means as vacuum deposition, or the charge-generating substance can be applied as a layer of a dispersion in a binder resin. Various resins can be used as the binder resin. For example, there can be mentioned olefin polymers such as a styrene polymer, an acrylic polymer, a styrene/acrylic copolymer, an ethylene/vinyl acetate copolymer, polypropylene and an ionomer, polyvinyl chloride, a vinyl chloride/vinyl acetate copolymer, a polyester, an alkyd resin, a polyamide, an epoxy resin, a polycarbonate, a polyarylate, a polysulfone, a diallyl phthalate resin, a silicone resin, a ketone resin, a polyvinyl butyral resin, a polyether resin, a phenolic resin, and photocurable resins such as an epoxy acrylate. These binder resins can be used singly or in the form of mixtures of two or more of them.

Various organic solvents can be used for forming a coating liquid. For example, there can be mentioned alcohols such as methanol, ethanol, isopropanol and butanol, aliphatic hydrocarbons such as n-hexane, octane and cyclohexane, aromatic hydrocarbons such as benzene, toluene and xylene, halogenated hydrocarbons such as dichloromethane, dichloroethane, carbon tetrachloride and chlorobenzene, ethers such as dimethyl ether, diethyl ether, tetrahydrofuran, ethylene glycol dimethyl ether and diethylene glycol dimethyl ether, ketones such as acetone, methylethylketone and cyclohexane, esters such as ethyl acetate and methyl acetate, and dimethylformamide and dimethylsulfoxide. These solvents can be used alone or in the form of mixtures of two or more of them.

Various materials having an electroconductivity can be used as the electroconductive substrate. For example, there can be mentioned single substances of metals such as aluminium, copper, tin, platinum, gold, silver, vanadium, molybdenum, chromium, cadmium, titanium, nickel, indium, stainless steel and brass, plastic materials vacuum-deposited or laminated with metals as mentioned above, and glass coated with aluminum iodide, tin oxide, indium oxide or the like.

The coating liquid is prepared by mixing the charge-generating substance, the binder resin and the like by using a roll mill, a ball mill, an attriter, a paint shaker or an ultrasonic disperser, and the coating liquid is coated by known means and dried.

In case of the substrate/CGL/CTL photosensitive material shown in FIG. 1, the thickness of CGL is in the range of from 0.01 to 0.05 μm when formed by the vacuum deposition or in the range of from 0.1 to 0.5 μm when formed by the coating, and the thickness of CTL is 5 to 40 μm, especially 10 to 25 μm. In case of the substrate/CTL/CGL photosensitive material shown in FIG. 2, the thickness of CTL is 5 to 40 μm, especially 10 to 25 μm, and the thickness of CGL is preferably 0.1 to 0.5 μm. In the case of the CTL/CGL dispersion type photosensitive material shown in FIG. 3, it is preferred that the charge-generating substance be present in an amount of 1 to 15 parts by weight, especially 5 to 10 parts by weight, per 100 parts by weight of the organic polysilane and the thickness of the photosensitive layer be 10 to 40 μm, especially 15 to 30 μm.

In the present invention, at least two kinds of the above-mentioned five kinds of additive compounds can be simultaneously incorporated in the organic polysilane. In this case, the above-mentioned effects can be similarly attained while exerting the functions of the respective additives.

The present invention will now be described in detail with reference to the following examples that by no means limit the scope of the invention.

EXAMPLE 1 synthesis of Phenylmethylpolysilane

To 400 ml of dry toluene were added 100 g of methylphenyl-dichlorosilane and 26 g of metallic sodium, and the mixture was heated at 130° C., stirred for 11 hours and cooled. The obtained reaction liquid (a solution containing a dark violet precipitate) was mixed with ethanol to convert the unreacted sodium to sodium ethoxide, and the precipitate was recovered by filtration, dried and dissolved in toluene. The solution was dropped into ethanol to effect re-precipitation and obtain white phenylmethylpolysilane in an amount of 22.0 g (the yield was 34%).

Preparation of Electrophotographic Photosensitive Material

A ball mill was charged with 100 parts by weight of α-type oxotitanylphthalocyanine as the charge-generating substance and 4000 parts by weight of tetrahydrofuran, and the mixture was stirred for 24 hours. Then, 100 parts by weight of polyvinyl butyral (S-lec BM-3 supplied by Sekisui Kagaku) was added to the mixture, and the mixture was stirred for 1 hour to form a charge-generating layer-forming coating liquid. The prepared liquid was coated on an aluminum foil by a wire bar (No. 5) and dried with hot air at 100° C. for 30 minutes to cure the coating and form a charge-generating layer having a thickness of 5 μm.

A charge-transporting layer-forming coating liquid was prepared by mixing and stirring 100 parts by weight of phenylmethylpolysilane as the charge-transporting substance, 10 parts by weight of 2,6-dichloro-p-benzoquinone (having an electronic affinity of 2.3) as the electron-accepting substance and 1000 parts by weight of tetrahydrofuran as the solvent by a homomixer. This coating liquid was coated on the charge-generating layer by a wire bar (No. 60) and dried with hot air at 100° C. for 30 minutes to form a charge-transporting layer having a thickness of about 5 μm, whereby a photosensitive material for the electrophotography was prepared.

EXAMPLE 2

A photosensitive material for the electrophotography was prepared in the same manner as described in Example 1 except that in the preparation of the charge-transporting layer-forming coating liquid, p-benzoquinone (having an electronic affinity of 1.98) was used as the electron-accepting substance instead of 2,6-dichloro-p-benzoquinone.

EXAMPLE 3

A single layer type photosensitive layer-forming coating liquid was prepared by mixing and stirring for 24 hours 100 parts by weight of phenylmethylpolysilane as the charge-transporting material, 4 parts by weight of α-type oxotitanylphthalocyanine as the charge-generating substance, 10 parts by weight of 2,6-dichloro-p-benzoquinone as the electron-accepting substance and 1000 parts by weight of tetrahydrofuran as the solvent by a ball mill. The coating liquid was coated on an aluminum foil by a wire bar (No. 60) and dried with hot air at 100° C. for 30 minutes to form a single layer type photosensitive layer having a thickness of about 10 μm, whereby a photosensitive material for the electrophotography was prepared.

COMPARATIVE EXAMPLE 1

A photosensitive material for the electrophotography was prepared in the same manner as described in Example 1 except that in the preparation of the charge-transporting layer-forming coating liquid, 2,6-dichloro-p-benzoquinone (having an electronic affinity of 2.3) was not added as the electron-accepting substance.

Comparative Example 2

A photosensitive material for the electrophotography was prepared in the same manner as described in Example 3 except that in the preparation of the charge-transporting layer-forming coating liquid, 2,6-dichloro-p-benzoquinone (having an electronic affinity of 2.3) was not added as the electron-accepting substance.

Example 4

A photosensitive material for the electrophotography was prepared in the same manner as described in Example 1 except that 2,6-dimethyl-2',6'-di-tert-butyldiphenoquinoe was used as the diphenoquinone derivative instead of 2,6-dichloro-p-benzoquinone as the electron-accepting substance.

Example 5

A photosensitive material for the electrophotography was prepared in the same manner as described in Example 4 except that 2,2-dimethyl6,6'-di-tert-butylphenoquinone was used as the diphenoquinone derivative instead of 2,6-dimethyl-2',6'-di-tert-butyldiphenoquinone in the preparation of the charge-transporting layer-forming coating liquid.

Example 6

A photosensitive material for the electrophotography was prepared in the same manner as described in Example 3 except that in that in the preparation of the charge-transporting layer-forming coating liquid, 2,6-dimethyl-2',6'-di-tert-butyldiphenoquinone was used as the diphenoquinone derivative instead of 2,6-dichloro-p-benzoquinone as the electron-accepting substance.

Example 7

A photosensitive material for the electrophotography was prepared in the same manner as described in Example 1 except that in the preparation of the charge-transporting layer-forming coating liquid, N,N,N',N'-tetrakis(3-tolyl)-1,3-phenylenediamine was used as the low-molecular-weight hole-transporting substance instead of 2,6-dichloro-p-benzoquinone as the electron-accepting substance.

Example 8

A photosensitive material for the electrophotography was prepared in the same manner as described in Example 7 except that in the preparation of the charge-transporting layer-forming coating liquid, N-ethyl-3-carbazolylaldehyde-N,N-diphenylhydrazone was used as the low-molecular-weight hole-transporting substance instead of N,N,N',N'-tetrakis(3-tolyl)-1,3-phenylenediamine.

Example 9

A photosensitive material for the electrophotography was prepared in the same manner as described in Example 3 except that in the preparation of the charge-transporting layer-forming coating liquid, N,N,N',N'-tetrakis(3-tolyl)-1,3-phenylenediamine was used as the low-molecular-weight hole-transporting substance instead of 2,6-dichloro-p-benzoquinone as the electron-accepting substance.

Example 10

A photosensitive material for the electrophotography was prepared in the same manner as described in Example 1 except that in the preparation of the charge-transporting layer-forming coating liquid, a high-molecular-weight polycyclic hindered phenol (Mark AO-30 supplied by Adeca-Argus) was used as the antioxidant instead of 2,6-dichloro-p-benzoquinone as the electron-accepting substance.

Example 11

A photosensitive material for the electrophotography was prepared in the same manner as described in Example 10 except that in the preparation of the charge-generating layer-forming coating liquid, metal-free phthalocyanine was used instead of α-type oxotitanylphthalocyanine as the charge-generating substance.

Example 12

A photosensitive material for the electrophotography was prepared in the same manner as described in Example 3 except that in the preparation of the charge-transporting layer-forming coating liquid, a high-molecular-weight polycyclic hindered phenol (Mark AO-30 supplied by Adeca-Argus) was used as the antioxidant instead of 2,6-dichloro-p-benzoquinone as the electron-accepting substance.

Comparative Example 3

A photosensitive material for the electrophotography was prepared in the same manner as described in Example 10 except that in the preparation of the charge-transporting layer-forming coating liquid, a low-molecular-weight hindered phenol (Antage BHT supplied by Kawaguchi Kagaku) was used as the antioxidant instead of the high-molecular-weight polycylic hindered phenol (Mark AO-30 supplied by Adeca-Argus).

Comparative Example 4

A photosensitive material for the electrophotography was prepared in the same manner as described in Example 10 except that in the preparation of the charge-transporting layer-forming coating liquid, an ultraviolet absorber (LA-36 supplied by Adeca-Argus) was used instead of the high-molecular-weight polyhydric hindered phenol (Mark AO-30 supplied by Adeca-Argus) as the antioxidant.

Comparative Example 5

A photosensitive material for the electrophotography was prepared in the same manner as described in Comparative Example 4 except that in the preparation of the charge-transporting layer-forming coating liquid, 100 parts by weight of the ultraviolet absorber (LA-36 supplied by Adeca-Argus) was used.

Comparative Example 6

A photosensitive material for the electrophotography was prepared in the same manner as described in Example 11 except that in the preparation of the charge-transporting layer-forming coating liquid, the high-molecular-weight polycyclic hindered phenol (Mark AO-30 supplied by Adeca-Argus) was not added as the antioxidant.

Example 13

A photosensitive material for the electrophotography was prepared in the same manner as described in Example 1 except that in the preparation of the charge-transporting layer-forming coating liquid, 4 parts by weight of N,N'-dimethylperylene-3,4,9,10-tetracarboxydiimide was used as the n-type charge-generating substance instead of 10 parts by weight of 2,6-dichloro-p-benzoquinone as the electron-accepting substance.

Example 14

A photosensitive material for the electrophotography was prepared in the same manner as described in Example 13 except that in the preparation of the charge-transporting layer-forming coating liquid, N,N'-di(3,5-dimethylphenyl)-perylene-3,4,9,10-tetracarboxydiimide was used as the n-type charge-generating substance instead of N,N'-dimethylperylene-3,4,9,10-tetracarboxydiimide.

Comparative Example 7

A photosensitive material for the electrophotography was prepared in the same manner as described in Example 13 except that in the preparation of the charge-transporting layer-forming coating liquid, an azo pigment (Chlorodian Blue supplied by Nippon Kanko Shikiso) was used as the p-type charge-generating substance instead of N,N'-dimethyl-perylene-3,4,9,10-tetracarboxydiimide as the n-type charge-generating substance.

Evaluation of Photosensitive Materials for Electrophotography

A sample was positively or negatively charged at ±6.0 kV by using an electrostatic copying tester (Model 8100 supplied by Kawaguchi Denki), and the electrophotographic characteristics were measured under conditions described below. The obtained results are shown in Table 2.

Light exposure time; 10 seconds
Applied light: wavelength of 780 nm
Light exposure intensity: 10 $\mu W/cm^2$
Dark decay after charging: 2 seconds In Table 2, $V_1$ (V) shows the initial surface voltage (V) of the photosensitive material observed when charged by application of the voltage under the above conditions, and $E_{1\frac{1}{2}}$ ($\mu J/cm^2$) shows the half-value light exposure quantity calculated from the light exposure time required for the surface voltage to decrease to ½ of the initial surface voltage $V_1$ (V). Furthermore, in Table 2, $V_{1rp}$ (V) shows the residual voltage corresponding to the surface voltage measured after the lapse of 5 seconds from the start of the light exposure. The attenuation ratio (%) was calculated according to the following formula:

$$\text{Attenuation ratio (\%)} = \frac{\text{initial voltage} - \text{residual voltage}}{\text{initial voltage}}$$

The photosensitive materials obtained in Examples 1 through 3 and Comparative Example 1 and 2 were irradiated with ultraviolet rays (300 to 400 nm, 60 $nW/cm^2$) for 2 minutes, and the photosensitive materials obtained in Examples 4 through 6 and Comparative Example 1 and 2 were irradiated with the same ultraviolet rays for 10 minutes. Then, with respect to each of the photosensitive materials, the surface voltage $V_2$ or $V_{10}$ (V), the half-value light exposure quantity $E_{2\frac{1}{2}}$ or $E_{10\frac{1}{2}}$ ($\mu J/cm^2$), the residual voltage $V_{2rp}$ or $V_{10rp}$ (V) and the attenuation ratio (%) were measured. The obtained results are shown in Tables 3 and 4.

The photosensitive materials obtained in Examples 4 through 14 and Comparative Examples 1 through 7 were subjected to charging-light exposure operations 100 times under the same conditions as described above except that the light exposure time was changed to 3 seconds and the time of the dark decay after charging was changed to 1 second. With respect to each of the tested photosensitive materials, the surface voltage $V_2$ (V), the half-value light exposure quantity $E_{2\frac{1}{2}}$ ($\mu J/cm^2$), the residual voltage $V_{2rp}$ (V) and the attenuation ratio (%) were measured. The obtained results are shown in Table 5.

TABLE 2

| | $V_{1sp}$ (V) | $E_{1\frac{1}{2}}$ ($\mu$J/cm) | $V_{1rp}$ (V) | Attenuation Ratio (%) |
|---|---|---|---|---|
| Example 1 | −644 | 0.60 | −20 | 95.1 |
| Example 2 | −602 | 0.60 | −20 | 96.6 |
| Example 3 | +512 | 0.62 | +22 | 95.7 |
| Comparative Example 1 | −562 | 0.61 | −18 | 96.9 |
| Comparative Example 2 | −501 | 0.63 | +17 | 96.6 |
| Example 4 | −586 | 0.52 | −24 | 96.7 |
| Example 5 | −602 | 0.60 | −20 | 96.7 |
| Example 6 | +613 | 0.69 | +23 | 96.2 |
| Example 7 | −630 | 0.60 | −24 | 96.2 |

TABLE 2-continued

| | $V_{1sp}$ (V) | $E_{1\frac{1}{2}}$ (μJ/cm) | $V_{1rp}$ (V) | Attenuation Ratio (%) |
|---|---|---|---|---|
| Example 8 | −552 | 0.59 | −23 | 95.8 |
| Example 9 | +586 | 0.66 | +23 | 96.1 |
| Example 10 | −615 | 0.73 | −11 | 98.2 |
| Example 11 | −610 | 0.82 | −11 | 98.2 |
| Example 12 | −583 | 0.73 | −23 | 96.1 |
| Comparative Example 3 | −654 | 0.93 | −48 | 92.7 |
| Comparative Example 4 | −556 | 0.55 | −34 | 93.9 |
| Comparative Example 5 | −704 | 0.58 | −36 | 94.9 |
| Comparative Example 6 | −644 | 0.80 | −62 | 90.4 |
| Example 13 | −702 | 0.63 | −10 | 98.6 |
| Example 14 | −622 | 0.67 | −4 | 99.4 |
| Comparative Example 7 | −550 | 0.79 | −23 | 95.8 |

TABLE 3

| | $V_{2sp}$ (V) | $E_{2\frac{1}{2}}$ (μJ/cm) | $V_{2rp}$ (V) | Attenuation Ratio (%) |
|---|---|---|---|---|
| Example 1 | −634 | 0.60 | −50 | 83.0 |
| Example 2 | −608 | 0.61 | −90 | 69.0 |
| Example 3 | +508 | 0.62 | +50 | 80.1 |
| Comparative Example 1 | −620 | — | −248 | 60.0 |
| Comparative Example 2 | +613 | — | +252 | 58.9 |

TABLE 4

| | $V_{10sp}$ (V) | $E_{10\frac{1}{2}}$ (μJ/cm) | $V_{10rp}$ (V) | Attenuation Ratio (%) |
|---|---|---|---|---|
| Example 4 | −594 | 0.52 | −36 | 93.9 |
| Example 5 | −610 | 0.61 | −48 | 92.1 |
| Example 6 | +624 | 0.68 | +42 | 93.3 |
| Comparative Example 1 | −620 | — | −316 | 49.0 |
| Comparative Example 2 | +612 | — | +322 | 47.5 |

TABLE 5

| | $V_{2sp}$ (V) | $E_{2\frac{1}{2}}$ (μJ/cm) | $V_{2rp}$ (V) | Attenuation Ratio (%) |
|---|---|---|---|---|
| Example 4 | −592 | 0.52 | −52 | 92.1 |
| Example 5 | −598 | 0.61 | −50 | 91.6 |
| Example 6 | +645 | 0.70 | +51 | 92.1 |
| Comparative Example 1 | −724 | 0.61 | −94 | 87.0 |
| Comparative Example 2 | +562 | 0.68 | +102 | 81.9 |
| Example 7 | −702 | 0.65 | −54 | 92.0 |
| Example 8 | −596 | 0.62 | −51 | 91.4 |
| Example 9 | +620 | 0.66 | +33 | 94.7 |
| Example 10 | −650 | 0.73 | −49 | 92.5 |
| Example 11 | −640 | 0.81 | −44 | 93.1 |
| Example 12 | +603 | 0.69 | +40 | 93.1 |
| Comparative Example 3 | −864 | 1.00 | −141 | 83.7 |
| Comparative Example 4 | −858 | 0.65 | −126 | 85.3 |
| Comparative Example 5 | −930 | 0.97 | −383 | 58.8 |
| Comparative Example 6 | −778 | 0.79 | −144 | 81.5 |
| Example 13 | −762 | 0.64 | −34 | 95.6 |
| Example 14 | −692 | 0.68 | −22 | 96.8 |
| Comparative Example 7 | −625 | 0.82 | −96 | 84.6 |

Form the foregoing results, it is seen that in a photosensitive material formed by using a composition comprising an organic polysilane and a member selected from the group consisting of an electron-accepting substance, a diphenoquinone derivative, a low-molecular-weight hole-transporting material, a high-molecular-weight polycyclic hindered phenol and an n-type charge-generating substance, changes of the surface voltage and residual voltage are very small under repetition of charging-light exposure operations or under irradiation with ultraviolet rays, and the photosensitive material has an excellent resistance to the repetition of charging-light exposure operations and an excellent light resistance.

We claim:

1. A laminated electrophotographic photosensitive material comprising a charge generating layer and a charge transporting layer laminated to each other in either order on a conductive substrate, wherein said charge transporting layer comprises from about 0.1 to about 30 parts by weight of a diphenoquinone derivative dispersed in 100 parts by weight of an organopolysilane layer composed of recurring units represented by the formula (1)

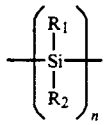

(1)

wherein $R_1$ and $R_2$ independently represent an alkyl group having up to 4 carbon atoms, an aryl group having at least 6 carbon atoms or an aralkyl group.

2. The laminated electrophotographic photosensitive material of claim 1 wherein the diphenoquinone derivative is a compound of formula (2)

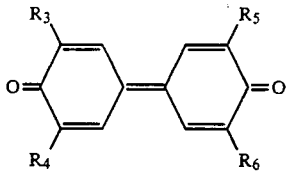

(2)

wherein $R_3$, $R_4$, $R_5$, and $R_6$ independently represent a hydrogen atom, an alkyl group, a cycloalkyl group, an aryl group or an aralkyl group.

3. An electrophotographic photosensitive material comprising a photosensitive layer on an electroconductive substrate, wherein said photosensitive layer comprises 0.1 to 30 parts by weight of a diphenoquinone derivative and 1 to 15 parts by weight of a charge generating material dispersed in 100 parts by weight of an organopolysilane layer, said organopolysilane comprising recurring units of the formula (1)

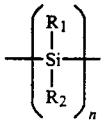

(1)

wherein $R_1$ and $R_2$ independently represent an alkyl group having up to 4 carbon atoms, an aryl group having at least 6 carbon atoms or an aralkyl group.

4. The laminated electrophotographic photosensitive material of claim 3 wherein the diphenoquinone derivative is a compound of formula (2)

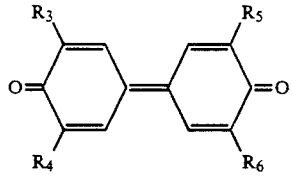

(2)

wherein $R_3$, $R_4$, and $R_6$ independently represent a hydrogen atom, an alkyl group, a cycloalkyl group, an aryl group or an aralkyl group.

5. A laminated electrophotographic photosensitive material comprising a change generating layer and a charge transporting layer laminated in this order or in a reverse order on an electroconductive layer, wherein said charge transporting layer comprises from about 0.1 to about 30 parts by weight of at least one electron accepting substance dispersed in 100 parts by weight of an organopolysilane, wherein said at least one electron accepting substance is selected from the group consisting of tetracyanoethylene, 2,4,7-trinitro-9-fluorenone, 3,4,5,7-tetranitro-9-fluorenone, chloranil, 1,4-naphthoquinone, and 2,6-dichlorobenzoquinone in an organopolysilane composed of recurring units of formula (1)

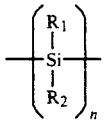

(1)

wherein $R_1$ and $R_2$ independently represent an alkyl group having up to 4 carbon atoms, an aryl group having at least 6 carbon atoms or an aralkyl group.

6. An electrophotographic photosensitive material comprising a photosensitive layer formed on an electroconductive substrate, wherein the photosensitive layer comprises from about 0.1 to 30 parts by weight of at least one electron accepting substance and 1 to 15 parts by weight of a charge generating material dispersed in 100 parts by weight of an organopolysilane layer, said at least one electron accepting substance being selected from the group consisting of tetracyanoethylene, 2,4,7-trinitro-9-fluorenone, 3,4,5,7-tetranitro-9-fluorenone, chloranil, 1,4-naphthoquinone, and 2,6-dichlorobenzoquinone and said organopolysilane comprising recurring units represented by the formula (1)

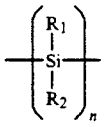

(1)

wherein $R_1$ and $R_2$ independently represent an alkyl group having up to 4 carbon atoms, an aryl group having at least 6 carbon atoms or an aralkyl group.

7. A laminated electrophotographic photosensitive material comprising a charge generating layer, a charge transporting layer laminated in this order or in a reverse order on an electroconductive substrate, wherein said charge transporting layer comprises from about 0.1 to about 30 parts by weight of an N,N,N',N'-tetraphenyl-m-phenylenediamine dispersed in 100 parts by weight of an organopolysilane, said N,N,N',N'-tetraphenyl-m-phenylenediamine being represented by formula (3)

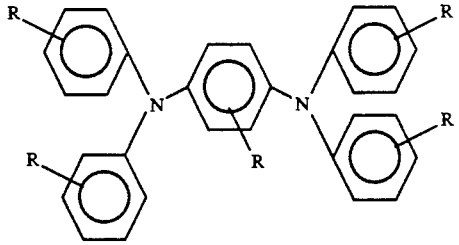

(3)

wherein R represents a hydrogen atom, an alkyl group, an alkoxy group or a halogen atom, in an organopolysilane layer composed of recurring units of formula (1)

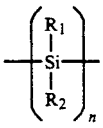

(1)

wherein $R_1$ and $R_2$ independently represent an alkyl group having up to 4 carbon atoms, an aryl group having at least 6 carbon atoms or an aralkyl group.

8. An electrophotographic photosensitive material comprising a photosensitive layer formed on an electroconductive substrate, wherein the photosensitive layer comprises 1 to about 15 parts by weight of a charge generating material and 1 to about 30 parts by weight of an N,N,N',N'-m-phenylenediamine dispersed in 100 parts by weight of an organopolysilane, said N,N,N',N'-m-phenylenediamine being represented by formula (3)

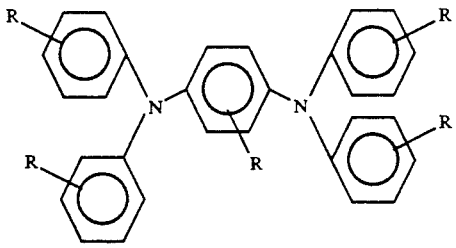

(3)

wherein R represents a hydrogen atom, an alkyl group, an alkoxy group, or a halogen atom, and said organopolysilane comprises of recurring units represented by the formula (1)

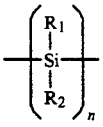

(1)

wherein $R_1$ and $R_2$ independently represent an alkyl group having up to 4 carbon atoms, an aryl group having at lest 6 carbon atoms, or an aralkyl group.

* * * * *